US010019917B1

(12) United States Patent
Mezzera

(10) Patent No.: US 10,019,917 B1
(45) Date of Patent: Jul. 10, 2018

(54) SIGN HOLDER AND SIGN FOR A CHAIR

(71) Applicant: Marcelo Mezzera, Rancho Santa Margarita, CA (US)

(72) Inventor: Marcelo Mezzera, Rancho Santa Margarita, CA (US)

( * ) Notice: Subject to any disclaimer, the term of this patent is extended or adjusted under 35 U.S.C. 154(b) by 0 days.

(21) Appl. No.: 15/442,012

(22) Filed: Feb. 24, 2017

(51) Int. Cl.
*G09F 7/00* (2006.01)
*G09F 7/18* (2006.01)
*G09F 7/02* (2006.01)
*G09F 23/00* (2006.01)

(52) U.S. Cl.
CPC ..... *G09F 7/18* (2013.01); *G09F 7/02* (2013.01); *G09F 23/00* (2013.01); *G09F 2007/1847* (2013.01); *G09F 2007/1856* (2013.01); *G09F 2023/005* (2013.01)

(58) Field of Classification Search
CPC ..... B61D 41/04; B61D 41/02; G09F 2023/00; G09F 2023/005; A47C 7/66; A47C 1/14; A47C 1/0242; A61G 5/10; A01K 97/01
See application file for complete search history.

(56) References Cited

U.S. PATENT DOCUMENTS 289,384 A * 12/1883 Byrkit ..... A47B 23/042 248/454
564,044 A * 7/1896 Berkemeyer ..... A47C 7/70 297/170
675,186 A * 5/1901 Bacon ..... A47B 83/02 108/30
1,571,352 A * 2/1926 Weston ..... A47F 5/13 211/88.01
2,375,696 A * 5/1945 Shick ..... A47B 19/002 297/174 R
4,886,229 A * 12/1989 Aripze-Gilmore ... A01M 31/02 248/125.1
5,102,190 A * 4/1992 Akin ..... A47C 7/66 135/90
5,301,999 A * 4/1994 Thompson ..... A47C 7/66 248/284.1
5,700,051 A * 12/1997 Newhouse ..... A47C 1/022 297/188.11
6,105,594 A * 8/2000 Diaz ..... A45B 11/00 135/16
6,375,259 B1 * 4/2002 Ma ..... A47C 7/72 297/154
6,676,208 B2 * 1/2004 Lu ..... A47B 83/008 297/16.1

(Continued)

*Primary Examiner* — Cassandra H Davis
(74) *Attorney, Agent, or Firm* — Morland C. Fischer

(57) ABSTRACT

This invention relates to a sign holder to carry a sign and be connected to a chair. The sign which displays information about the chair is removable from the sign holder to be replaced by a different sign having different information. The sign holder includes a vertically upstanding shaft that extends between the seat and the back of the chair. A chair attachment bracket which extends horizontally from the bottom of the vertically upstanding shaft is detachably connected to the bottom of the chair seat. A sign carrying bracket which extends horizontally from the top of the vertically upstanding shaft holds the sign adjacent one side of the chair back. The sign has a front which contains the information to be displayed, a back, and a closed top extending between the front and the back to be supported by the sign carrying bracket at the top of the shaft of the sign holder.

10 Claims, 2 Drawing Sheets

(56) References Cited

U.S. PATENT DOCUMENTS

| | | | | |
|---|---|---|---|---|
| 6,705,334 | B2 * | 3/2004 | Altobelli | A45B 11/00 108/50.12 |
| 7,475,939 | B1 * | 1/2009 | Hooker | A47C 7/66 135/96 |
| 8,955,905 | B2 * | 2/2015 | Boenigk | A47C 7/70 297/135 |
| 2003/0042772 | A1 * | 3/2003 | Park | A61B 1/00048 297/217.1 |
| 2008/0029137 | A1 * | 2/2008 | McInville | E04H 12/2269 135/16 |

* cited by examiner

SIGN HOLDER AND SIGN FOR A CHAIR

BACKGROUND OF THE INVENTION

1. Field of the Invention

This invention relates to a sign holder that is adapted to be detachably connected to the bottom of the chair in order to hold a sign adjacent one side of the chair. The sign contains advertising information about the chair that is to be displayed to passersby.

2. Background Art

Chairs are offered for sale at a variety of home and office furniture stores. In order to improve the marketability of a chair, a sample chair is often made available for inspection by shoppers. Advertising information, including the price and details of the chair, is typically printed on a tag or label, and the tag or label is affixed to the back or seat of the chair. However, in many cases, the information is small and hard to read. Thus, the information may be misunderstood or completely overlooked. In other cases, the tag or label can become accidentally separated from the chair and lost. Should information (e.g., the price) concerning the chair change, it can be an inconvenient process for store personnel to change the sign to reflect the new information, particularly when many chairs are involved.

What would therefore be desirable is a vertically upstanding sign holder that is adapted to be connected to a chair in order to hold an advertising sign adjacent the chair so that information contained by the sign can be easily read by passersby. It would also be desirable for the sign holder to be disconnected from the chair in the event that the chair is transported, stored or sold. It would also be desirable for both the sign and the sign holder to be configured so that the sign can be quickly and easily removed from the sign holder to be replaced by a different sign containing different information.

SUMMARY

Briefly, and in general terms, a sign holder and a sign carried thereby are disclosed to be connected to an article of furniture, namely, a chair. The sign holder includes a vertically upstanding shaft having a length that extends between the seat and the back of the chair. A chair attachment bracket extends horizontally from the bottom of the vertically upstanding shaft. The chair attachment bracket is detachably connected by means of fasteners to the bottom of the chair seat, whereby to reliably retain the sign holder in place. A sign carrying bracket extends horizontally from the top of the vertically upstanding shaft so as to hold the sign carried by the sign holder adjacent one side of the chair back.

The sign preferably has a front, a back spaced behind the front, a closed top extending between the front and the back, closed sides, and an open bottom. Advertising information concerning the chair is printed on the front of the sign. The sign is attached to the sign holder by moving the sign downwardly towards the vertically upstanding shaft of the sign holder until the sign carrying bracket that extends horizontally from the top of the shaft is received through the open bottom and against the closed top of the sign. The sign is thusly positioned to surround and be supported by the sign carrying bracket of the sign holder so that the sign is held alongside the chair back. The sign is easily removed from the sign holder by lifting the sign upwardly and off the sign carrying bracket at the top of the vertically upstanding shaft to be replaced by a new sign having different advertising information concerning the chair.

DESCRIPTION OF THE PREFERRED EMBODIMENT

Figures 1, 2:
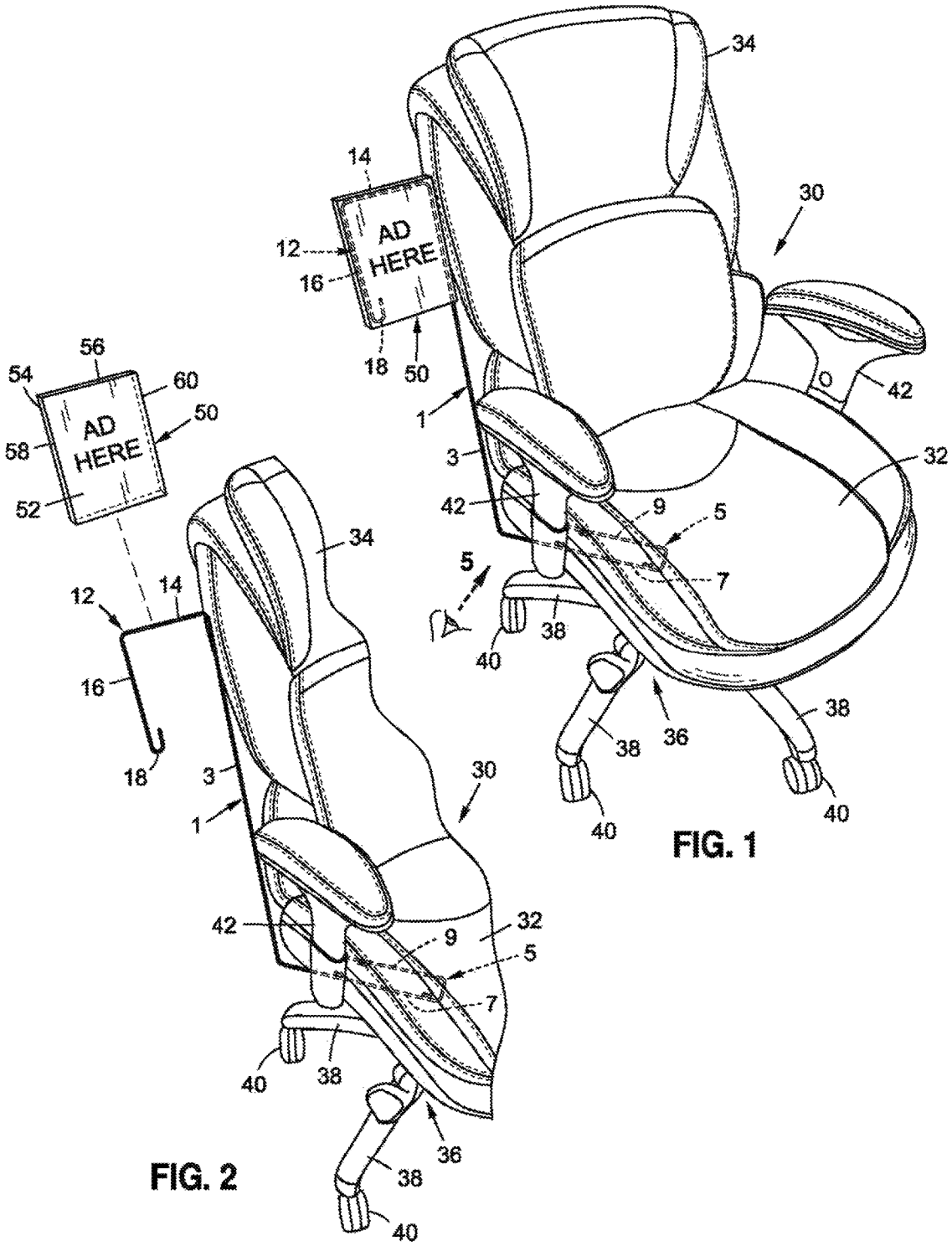
FIG. 1 shows one example of a chair to which the sign holder and an advertising sign which form a preferred embodiment of this invention are detachably connected.
FIG. 2 shows the sign being removably attached to the sign holder so as to be held by the sign holder adjacent one side of the back of the chair of FIG. 1.

A sign holder 1 and a sign 50 carried by the sign holder 1 are shown in FIGS. 1 and 2 of the drawings detachably connected to a chair 30. The sign 50 that is carried by the sign holder 1 contains any of a variety of (e.g., advertising and/or price) information to be displayed concerning the chair 30 to which the sign holder 1 is detachably connected. In this same regard, the sign 50 is removable from the sign holder 1 to be replaced by a different sign which carries different information about the chair 30.

The chair 30 to which the sign holder is connected is conventional and, therefore, forms no part of the improvement described herein. Briefly, however, and as is best shown in FIG. 1, the chair 30 is of the kind that can be used in a home or office and includes a seat 32 on which a user is seated and a back 34 that stands upwardly from the seat to support the user's back. The seat 32 and the back 34 of the chair 30 shown in FIG. 1 are pivotally connected to and held above the ground by a base 36 so that the seat and back are adapted to tilt back and forth relative to the base 36 as the user shifts his weight in the chair. The chair base 36 includes a plurality of outstretched legs 38 to which rollers 40 are attached to permit the chair to roll from place-to-place over a flat surface. A pair of arms 42 are connected to respective opposite sides of the seat 32.

Figures 3, 4, 5:
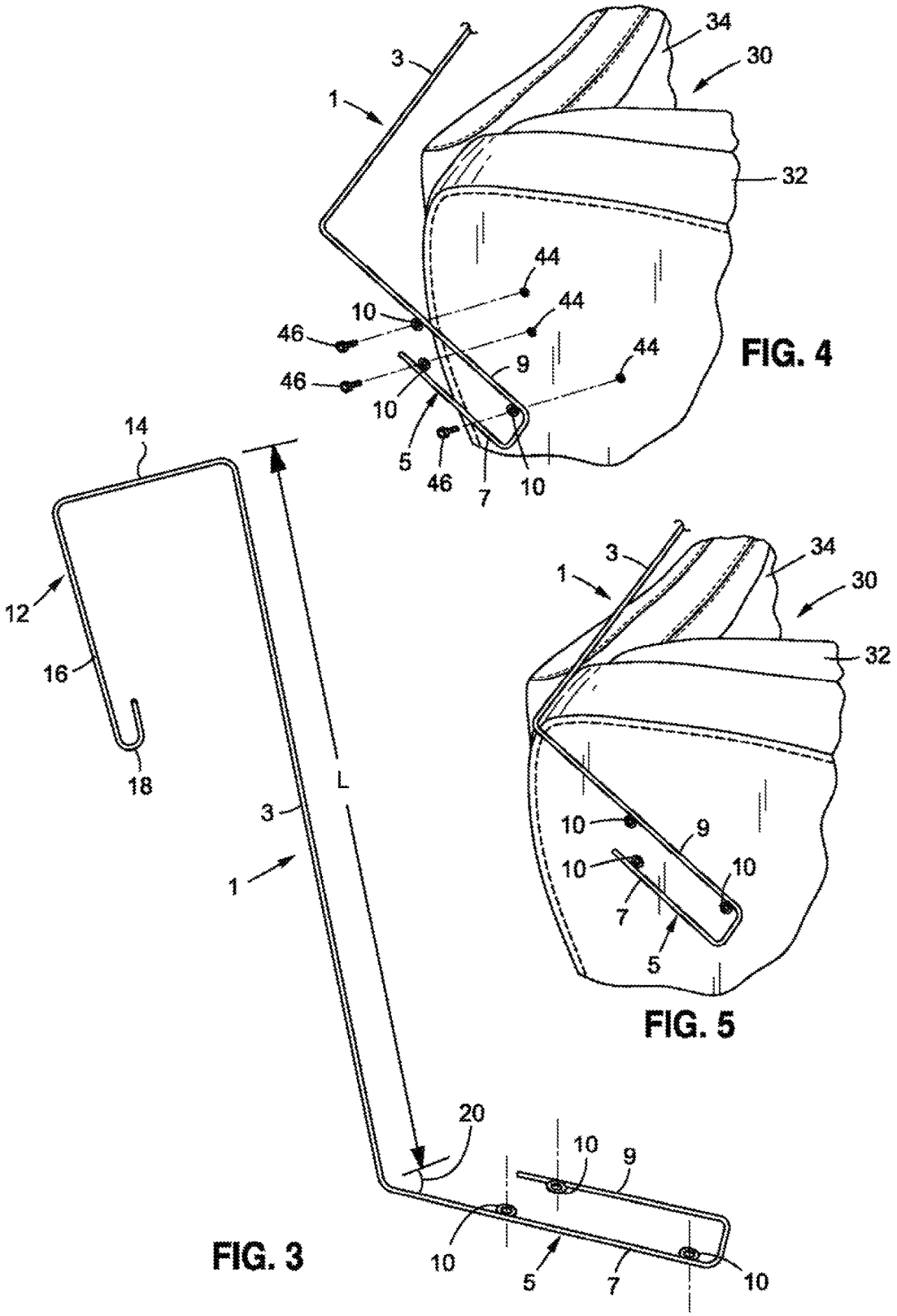
FIG. 3 illustrates details of the sign holder having a chair attachment bracket at the bottom thereof and a sign carrying bracket at the top.
FIG. 4 shows the chair attachment bracket which lies at the bottom of the sign holder of FIG. 3 being detachably connected to the bottom of the chair seat.
FIG. 5 shows the chair attachment bracket which lies at the bottom of the sign holder of FIG. 3 detachably connected to the bottom of the chair seat such that the sign holder extends alongside the chair.

In accordance with the present invention, and as is best shown in FIG. 3, the sign holder 1 is manufactured from wire and includes an elongated vertically upstanding shaft 3 having a length (designated L) which is approximately equal to the distance between the bottom of the seat 32 and the top of the back 34 of the chair 30. A generally U-shaped chair attachment bracket 5 is coextensively connected to the bottom of the vertically upstanding wire shaft 3. The chair attachment bracket 5 has a first section 7 that bends outwardly and extends horizontally from the bottom of the shaft 3 and a second section 9 that bends from the first section 7 and extends horizontally back towards shaft 3. A set of fastener retaining rings 10 is affixed (e.g., welded) to the first and second horizontally extending sections 7 and 9 of the chair attachment bracket 5.

Located opposite the chair attachment bracket 5 of the sign holder 1 is a U-shaped sign carrying bracket 12. The sign carrying bracket 12 is coextensively connected to the top of the vertically upstanding shaft 3. Bracket 12 has a first section 14 that bends outwardly and extends horizontally from the shaft 3 and a second section 16 that bends vertically and extends downwardly from the first horizontally extending section 14 such that the vertical second section 16 of bracket 12 lies in spaced parallel alignment with the vertically upstanding shaft 3. A third section 18 of the chair attachment bracket 12 bends upwardly from the downwardly extending second section 16 thereof so as to extend towards the first horizontal section 14 and thereby create an upturned end for the chair attachment bracket 5.

It may be appreciated that the chair attachment bracket 5 and the sign carrying bracket 12 at the bottom and the top of the sign holder 1 extend outwardly and in generally opposition directions from the wire shaft 3. However, to facilitate the connection of the sign holder 1 to the bottom of the seat 32 of the chair 30 so that the sign 50 will be positioned alongside the back 34 of chair 30, the chair alignment bracket bends in front of a vertical plane in which the shaft 3 and the sign carrying bracket 12 are located so as to make an angle therewith (designated 20 in FIG. 3) of approximately 45 degrees.

Referring particularly in this regard to FIGS. 3-5, the details are provided for detachably connecting the sign holder 1 to the bottom of the chair seat 32. A set of threaded holes (designated 44 in FIG. 4) are formed in the bottom of the chair seat 32. The number of threaded holes 44 formed in the bottom of the seat 32 corresponds with the number of fastener retaining rings that are affixed to the chair attachment bracket 5 of the sign holder 1.

The chair attachment bracket 5 of the sign holder 1 is laid flush against the bottom of the chair seat 32 so that the fastener retaining rings 10 thereof are axially aligned with respective ones of the threaded holes 44 formed in the bottom of the seat 32 (best shown in FIG. 5). Threaded fasteners 46 are then rotated into mating engagement with the threaded holes 44 by way of the fastener retaining rings 10 (best shown in FIG. 4), whereby the chair attachment bracket 5 of the sign holder 1 is connected to chair 30 below the seat 32 thereof and the sign holder 1 is attached to the chair when the chair 30 is located on the floor of a show room or a retailer at which the chair is offered for sale. During those times when the chair 30 will be stored or transported in a shipping container, the fasteners 46 are removed from the threaded holes 44 and the chair attachment bracket 5 is disconnected from the chair seat 34, whereby the sign holder 1 is separated from the chair 30.

The wire shaft 3 of the sign holder 1 stands vertically upwardly from the chair attachment bracket 5 when the bracket 5 is attached below the seat 32 of the chair 30. Because the chair attachment bracket 5 is aligned at an angle (designated 20 in FIG. 2) with respect to the vertical plane in which the shaft 3 and the sign carrying bracket 12 of the sign holder 1 are located, and as is best shown in FIGS. 1 and 2, the sign carrying bracket 12 is positioned behind the chair attachment bracket 5 to lie adjacent one side of the chair back 34.

The sign 50 to be removably attached to the sign holder 1 is coupled to the sign carrying bracket 12 thereof in order to be held alongside the back 34 of the chair 30 at which to display the information concerning the chair. The sign 50 is manufactured from paper or plastic, although the particular material of manufacture should not be considered a limitation of this invention. The sign 50 preferably has a configuration which resembles a box and includes a flat front 52, a flat back 54 lying opposite and spaced from the front, a closed top 56, closed sides 58 and 60, and an open bottom 62. In this case, the sign 50 is simply moved downward towards the sign holder 1 until the sign carrying bracket 12 thereof is received through the open bottom of the sign 50 whereby the sign 50 surrounds bracket 12. As is best shown in FIG. 1, when the sign 50 surrounds the sign carrying bracket 12 of the sign holder 1, the sign 50 will lay on and be supported by the horizontal section 14 of bracket 12 while the top of the upstanding wire shaft 3 of the sign holder 1 and the spaced, opposing downwardly extending vertical section 16 of the sign carrying bracket 12 are located along respective ones of the closed opposite sides 58 and 60 of the sign 50.

Therefore, with the sign 50 held in place by the sign holder 1 adjacent one side of the back 34 of the chair 30, information about the chair can be displayed to passersby at one or both of the front and back 52 and 54 of the sign 50. Should the information concerning the chair 30 change and/or when it is desirable to replace the sign 50 with a different sign having different information, the sign 50 is simply lifted upwardly and off the sign carrying bracket 12 of the sign holder 1.

Although the sign 1 has been described above as having closed sides 58 and 60 and an open bottom 62, other configurations are contemplated which enable the sign 1 to be removably attached to the sign carrying bracket 12 of the sign holder 1. By way of example, one of the sides 60 of the sign 1 can be open and the bottom of the sign 50 can be either open or closed. In this case, the sign 50 is pushed sideways towards the side of the chair 30 along which the sign holder 1 is to be positioned. The closed top 56 of the sign 50 will then slide past the vertical section 16 of the sign carrying bracket 12 of the sign holder 1 to be supported by the horizontal section 14 of the bracket 12 by which the sign 50 is once again held in place alongside the chair 30.

While the sign holder 1 has also been described as being attached to a chair 30 to display information to passersby concerning the chair, it is to be understood that the sign holder 1 of this invention may also be detachably connected to the other articles of furniture, such as a sofa or the like.

The invention claimed is:

1. A combination comprising:

a chair including a seat having a top and a bottom and also including a back having opposite sides and standing upwardly from the seat to support a user's back;

a sign having information to be displayed concerning the chair; and a sign holder having a top and a bottom and a vertically upstanding shaft extending between said top and said bottom of said chair, the bottom of said sign holder being detachably connected to the chair at the bottom of the seat thereof by means of at least one fastener which passes through the bottom of said sign holder for removable receipt by the bottom of said seat, and the sign being coupled to the top of said sign holder so that the information to be displayed by said sign is visible to passersby, wherein the vertically upstanding shaft of said sign holder has first and opposite ends and wherein the top of said sign holder includes a first section extending horizontally from and being joined to the first end of the vertically upstanding shaft of said sign holder so as to engage and hold said sign adjacent the one of the sides of the back of said chair, wherein the vertically upstanding shaft of said sign holder lies adjacent the back of the chair.

2. The combination recited in claim 1, wherein the top of said sign holder also includes a second section extending vertically downward from said horizontally extending first section, said second section lying in spaced parallel alignment with said vertically upstanding shaft such that said second section also engages and holds said sign adjacent the one of the sides of the back of said chair.

3. The combination recited in claim 1, wherein the bottom of said sign holder includes a first section extending horizontally from the opposite end of the vertically upstanding shaft of said sign holder, said first section being detachably connected by means of said at least one fastener to said chair below the seat thereof.

4. The combination recited in claim 3, wherein said vertically upstanding shaft and said horizontally extending first section of the top of said sign holder are located in a vertical plane, the horizontally extending first section of the bottom of said sign holder being aligned with said vertical plane such that an angle is formed therebetween.

5. The combination recited in claim 3, wherein the bottom of said sign holder also includes a second section extending from said horizontally extending first section thereof and bending from said first section back towards the opposite end of said vertically upstanding shaft, said second section also being connected to said chair below the seat thereof.

6. The combination recited in claim 1, wherein said sign includes a front containing the information to be displayed, a back located opposite and spaced from said front, and a closed top extending between said front and said back, said closed top being located on and supported by the horizontally extending first section of the top of said sign holder by which said sign is held by said sign holder adjacent the one of the sides of the back of said chair.

7. The combination recited in claim 6, wherein said sign also includes an open bottom lying opposite said closed top, the horizontally extending first section of the top of said sign holder being movable through the open bottom of said sign and into engagement with the closed top thereof so that said sign is supported and held by said horizontally extending first section.

8. The combination recited in claim 7, wherein said sign also includes a pair of closed sides being spaced from one another and extending between the closed top and the open bottom of said sign, such that said sign surrounds the first end of said vertically upstanding shaft and the first section of the top of said sign holder extending horizontally from the first end of said shaft.

9. A combination comprising:

an article of furniture having a seat and a back standing upwardly from the seat;

a sign having information to be displayed concerning the article of furniture, said sign including a front, a back spaced from and lying opposite the front, a closed top extending between the front and the back, and at least one open end extending between the front and the back; and a sign holder including a vertically upstanding shaft having a top and a bottom and lying adjacent the back of the article of furniture, a sign carrying portion extending horizontally from the top of said vertically upstanding shaft, and a furniture attachment portion extending horizontally from the bottom of said vertically upstanding shaft, said sign being removably attached to said sign holder by way of the open end of said sign such that the closed top of said sign lays on and is supported by the sign carrying portion of said sign holder extending horizontally from the top of said vertically upstanding shaft, whereby the sign surrounds said sign carrying portion, and the furniture attachment portion of said sign holder extending horizontally from the bottom of said vertically upstanding shaft is attached to said article of furniture below the seat thereof so that said sign is held by said sign holder adjacent the back of said article of furniture to enable the information concerning the article of furniture to be displayed to passersby.

10. The combination recited in claim 9, wherein said article of furniture is a chair, and wherein the furniture attachment portion of the sign holder extending horizontally from the bottom of the vertically upstanding shaft of said sign holder is connected to the bottom of the seat of said chair.

* * * * *